US006066992A

United States Patent [19]

Sadaka et al.

[11] Patent Number: 6,066,992

[45] Date of Patent: May 23, 2000

[54] VARIABLE ISO ATTENUATOR USING ABSORPTIVE/REFLECTIVE ELEMENTS AND LATCHING

[75] Inventors: Tarek C. Sadaka, Los Angeles; Christopher A. Jacobsen, Palmdale; Ralf R. Ihmels, Redondo Beach, all of Calif.

[73] Assignee: Hughes Electronics Corporation, El Segundo, Calif.

[21] Appl. No.: 09/132,994

[22] Filed: Aug. 12, 1998

[51] Int. Cl.[7] ..... H01P 1/22

[52] U.S. Cl. ..... 333/81 B; 333/1.1

[58] Field of Search ..... 333/1.1, 81 A, 333/81 B

[56] References Cited

U.S. PATENT DOCUMENTS 3,289,113 11/1966 Boutelant ..... 333/1.1 X
3,305,797 2/1967 Clavin ..... 333/1.1
3,812,437 5/1974 Marx ..... 333/81 A
4,460,879 7/1984 Hirose ..... 333/1.1 X
4,559,489 12/1985 Vacanti et al. ..... 333/1.1

*Primary Examiner*—Paul Gensler
*Attorney, Agent, or Firm*—Terje Gudmestad; M. W. Sales

[57] ABSTRACT

A variable absorptive/reflective high power attenuator for attenuating microwave signals in a communication system is formed from a circulator connected to a section transmission line such as a waveguide, having at least one adjustable tuning element connected thereto. The transmission line itself is terminated with a microwave energy absorbing load. A signal injected into the circulator is partially reflected by the tuning element(s), and partially absorbed in the load. The reflected portion is routed to an output port of the circulator. The non-reflected portion is dissipated as heat by the load. The amount of output of signal attenuation is selectively controlled by the location and penetration of the tuning elements. In another embodiment, a latching type circulator is utilized to allow selective switching of the attenuation level insitu. More than one such switching type attenuator can be cascade connected to form a single customizable and variable attenuator design.

10 Claims, 3 Drawing Sheets

Fig. 3
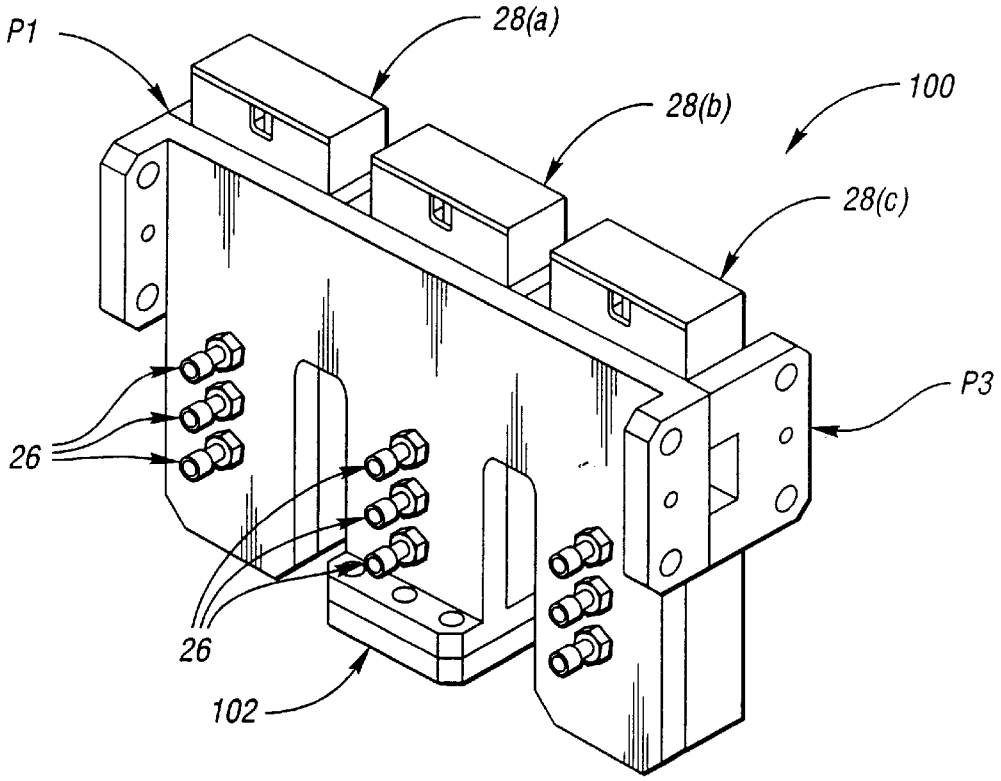
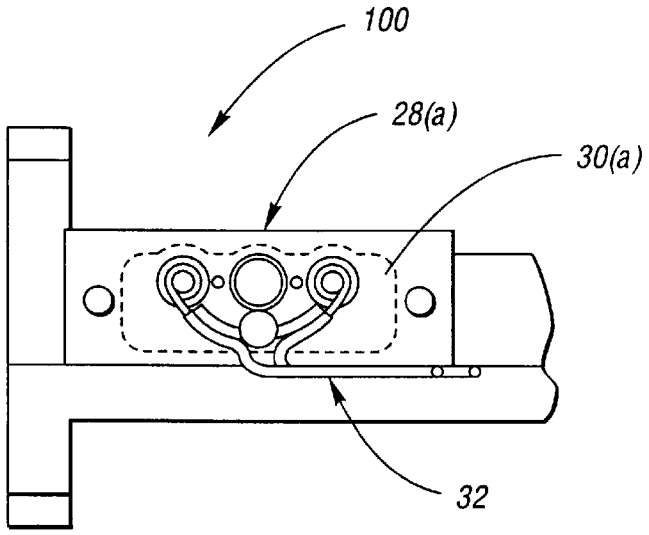
Fig. 4

VARIABLE ISO ATTENUATOR USING ABSORPTIVE/REFLECTIVE ELEMENTS AND LATCHING

This invention was made with Government support. The Government has certain rights in this invention.

TECHNICAL FIELD

The present invention generally relates to attenuators for use in microwave communications, and more particularly to a tunable, variable attenuator which is capable of use in high power applications.

BACKGROUND ART

Waveguide attenuators for use in satellite/microwave communications are generally constructed using lossy dielectric fins positioned to penetrate into a waveguide parallel to the electric fields to reduce the energy level of a signal at the output of the attenuator. These fixed or flap type attenuators suffer from several drawbacks. For example, known variable attenuators are typically long and heavy, especially when made to be tunable. Further, because the lossy dielectric fins are suspended in the waveguide cavity, the fins can not be provided with a suitable heat-sink arrangement. As a result, power handling capabilities are substantially limited by poor thermal conductivity characteristics of the lossy dielectric fins which must absorb portions of both incident and reflected power signal to effect the desired attenuation. Thus, such attenuators can not be employed in high power applications.

In addition, these known attenuators only have a single state of operation. More specifically, the designs of these attenuators only permits attenuation at a single, predetermined value. Thus, a need exists for an attenuator which overcomes these deficiencies.

DISCLOSURE OF INVENTION

It is therefore an object of the present invention to provide a variable attenuator for use in microwave communications which can handle high power signals.

It is another object of the present invention to provide an attenuator for use in microwave communications which can be selectively switched in-situ between two states.

It is yet another object of the present invention to provide an attenuator for use in microwave communications which can be selectively switched in-situ to control the amount of signal attenuation.

In accordance with these and other objects, the present invention provides a variable waveguide attenuator formed from a circulator having an input port for receiving a signal, an intermediate port, an output port for outputting an attenuated signal, and means for routing of signals received at the input port to the intermediate port, and routing of signals received at the intermediate port to the output port, a section of transmission line having a first end coupled to the intermediate port and a second end coupled to a terminating load, and at least one variable tuning element coupled to the transmission line for reflecting a predetermined amount of signal passing through the transmission line back toward the first end. The reflected portion of the received signal is then routed by the circulator to the output port, while the remaining non-reflected portion of the received signal is absorbed by the terminating load. In accordance with one aspect of the present invention, the at least one tuning element includes a plurality of screws accessible from an external surface of a waveguide transmission line to allow adjustment of the portion protruding into the waveguide. The transmission line can alternatively be a microstrip or coaxial cable.

In accordance with another aspect of the present invention, a latching type circulator is utilized to allow selective switching of the signal routing so that signals received at the input port are routed directly to the output port. In addition, several such switching attenuators can be cascade connected in series to allow insitu customization of total attenuation.

In accordance with still another aspect of the present invention, a method for attenuating signals in a communication system provides a variable absorptive/reflective high power attenuator formed from a circulator connected to a section of transmission line having at least one adjustable tuning element coupled thereto. One portion of the transmission line is terminated with a microwave energy absorbing load. A signal injected into the circulator is partially reflected by the tuning element(s), and partially absorbed in the load. The reflected portion is routed to an output port of the circulator. The amount of output power is controlled by the location and penetration of the tuning element(s).

Thus, the present invention provides a high power absorptive/reflective attenuator capable of producing high attenuation values with consistent and predictable RF characteristics, such as flatness, and tracking of output signal response. The power handling capability is only limited by the thermal capabilities of the circulator and the load, and by multipaction at the tuning elements. The present invention also provides stable matching over temperature at all levels of attenuation. Due to the electric properties of the circulators, the microwave source (e.g., traveling wave tube amp (TWTA), solid-state power amp (SSPA)) will always be well terminated with the match mainly depending on the return loss of the circulator. The attenuation is fairly constant over a narrow frequency band. For easier tuning, the location and penetration of the tuning elements can be predicted on a computer for a given attenuation.

In addition, the selective switching between no attenuation and a predetermined amount of attenuation allows reconfiguration of a series of cascade connected attenuators to any desired level of attenuation.

The above objects and other objects, features, and advantages of the present invention are readily apparent from the following detailed description of the best mode for carrying out the invention when taken in connection with the accompanying drawings.

BRIEF DESCRIPTION OF DRAWINGS

FIG. 3 is a perspective view of a cascaded ISO attenuator in accordance with the present invention;

FIG. 4 is a partial top view of the attenuator of FIG. 3;

BEST MODE FOR CARRYING OUT THE INVENTION

Figure 1:
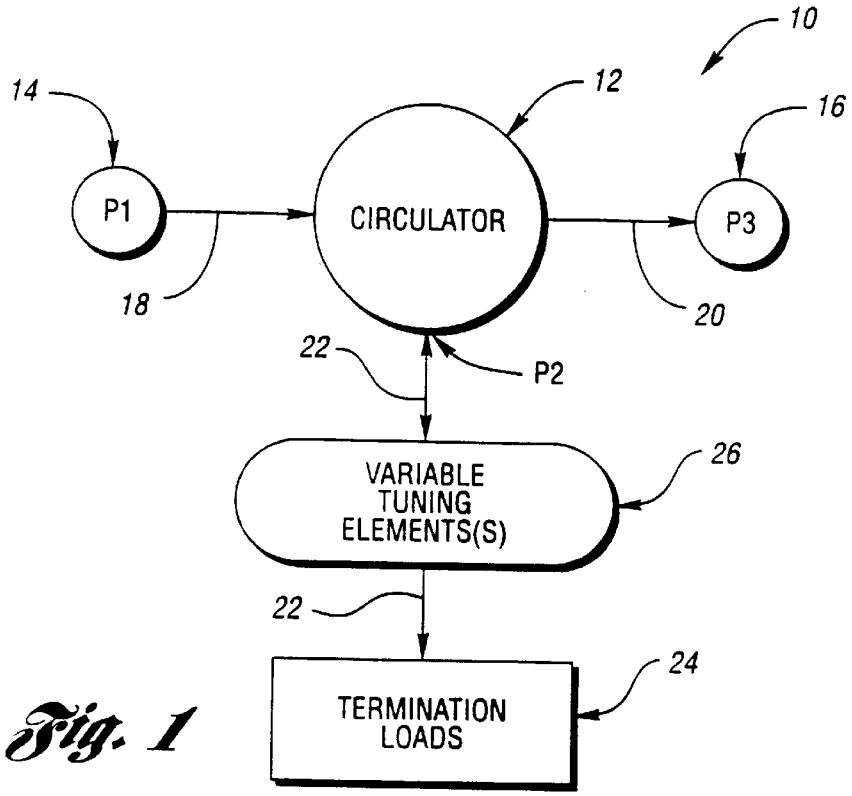
FIG. 1 is a schematic representation of a variable attenuator in accordance with a first embodiment of the present invention.

FIG. 1 is a schematic representation of an attenuator 10 in accordance with the present invention. Attenuator 10 is formed from a fixed junction circulator 12 connected to an input port (P1) 14, an out put port (P3) 16, and an intermediate port (P2) via respective sections of transmission line 18 and 20. One end of another section of transmission line 22 is connected to the circulator at P2, and the other end of transmission line 22 is connected to a termination load 24. Transmission lines 18–22 can be implemented as waveguides (such as described in the embodiments below), coaxial cable, or microstrip devices. At least one variable tuning element 26 is coupled to transmission line 22 between P2 and the termination load to vary the amount of attenuation as further described below. Alternatively, a tunable section of transmission line could be employed depending on the type of transmission line used.

Circulator 12 is constructed in accordance with well known design principals as a fixed junction type circulator to controllably route signals between respective pairs of the three ports P1, P2, and P3. While not to be construed as limiting, circulator 12 could be formed as a stripline junction circulator in which two ferrite disks fill spaces between a center metallic disk and ground planes of the stripline, and three stripline conductors are attached in 120 degree increments about the periphery of the center disk. Circulator 12 operates to produce electrical properties which cause microwave energy injected into an input port 14 to be transferred to a port P2 interfacing between circulator 12 and transmission line 22 without any significant decrease in magnitude. From port P2, the energy propagates through transmission line 22 toward load 24.

In accordance with the present invention, the tuning element(s) 26 operate as a de-tuned filter allowing a portion of the signal energy to pass and propagate into load 24 for dissipation in the form of heat. The remaining portion of signal energy is reflected back to port P2 of circulator 12 for subsequent transfer/routing to an output port 16 without any significant decrease in magnitude. Thus, the energy available at port 16 equals the incident energy at port 14 minus the energy dissipated in load 24, allowing for a very small and negligible insertion loss in circulator 12.

Figure 2:
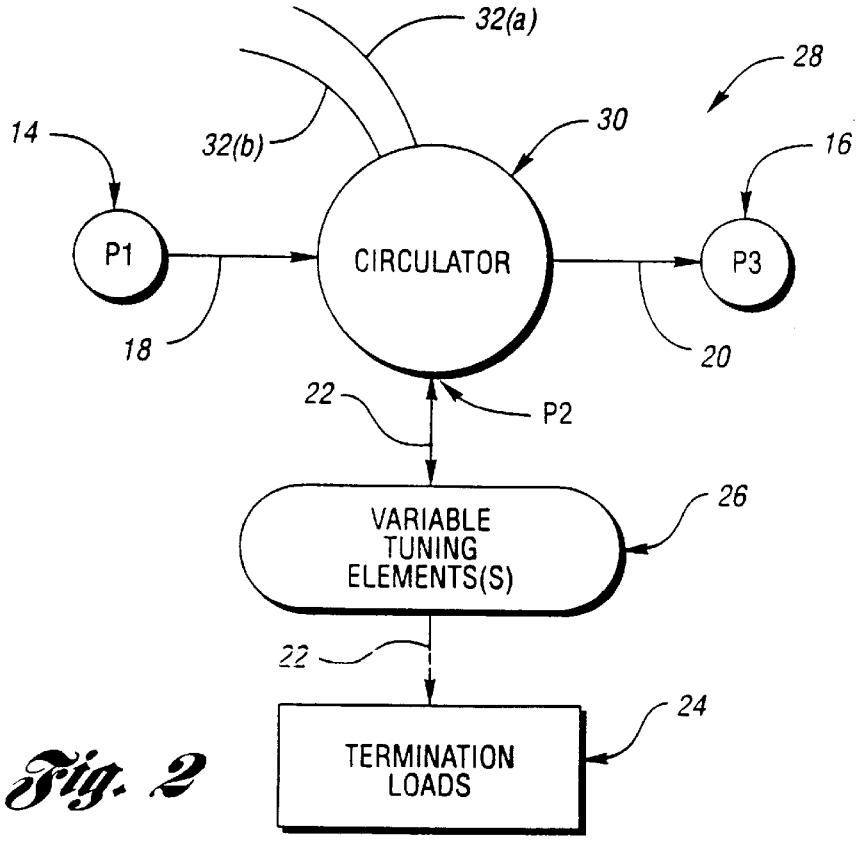
FIG. 2 is a schematic representation of a switchable attenuator in accordance with a second embodiment of the present invention.

FIG. 2 is a schematic representation of a second embodiment 28 of a switchable attenuator in accordance with the present invention. Attenuator 28 is similar to attenuator 10 with like elements being designated with identical reference numbers. However, in attenuator 28, the fixed junction circulator 12 has been replaced with a latching junction type circulator 30. Thus, in a first operating state, attenuator 28 operates similarly to attenuator 10 by passing signals received at P1 to P2, and signals received at P2 to P3. By reversing the magnetic field generated by the circulator, a second operating state is created in which signals received at P1 are passed directly to P3 with only a negligible loss within the circulator. Switching can be done internally to the circulator, such as by reversing the direction of current passing through control wires 32(*a*) and (*b*) coupled to the ferrite junction of the circulator (as shown in FIG. 2), or externally via a set of electromagnetic coils positioned about the circulator. Internal switching is preferred because the switching response is faster, and the components are smaller and weigh less.

FIG. 3 is a perspective view of a cascaded attenuator 100 in accordance with the present invention which incorporates three switchable attenuators 28(*a*)–(*c*) series connected to each other. While three attenuators are shown, one of ordinary skill in the art will appreciate that any number can be employed. In the cascaded arrangement of FIG. 3, the operating state of each individual attenuator can be selected to customize the overall amount of attenuation provided for a signal entering attenuator 28(*a*) and exiting attenuator 28(*c*). FIG. 4 shows a partial top view of attenuator 100 showing the internal switching wires 32 coupled to a circulator 30(*a*). A removable inspection/testing cover 102 is also shown in FIG. 3.

Figure 5:
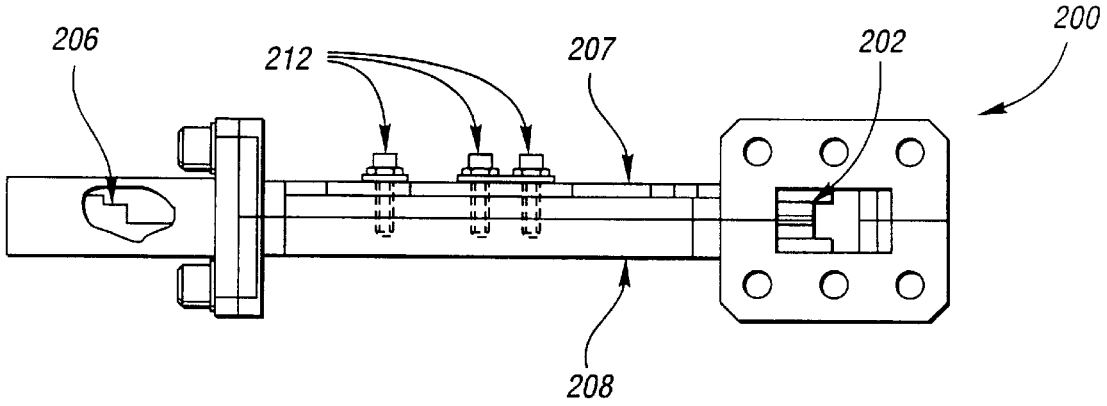
FIG. 5 is a side view of a high power waveguide ISO attenuator in accordance with the present invention.
Figure 6:
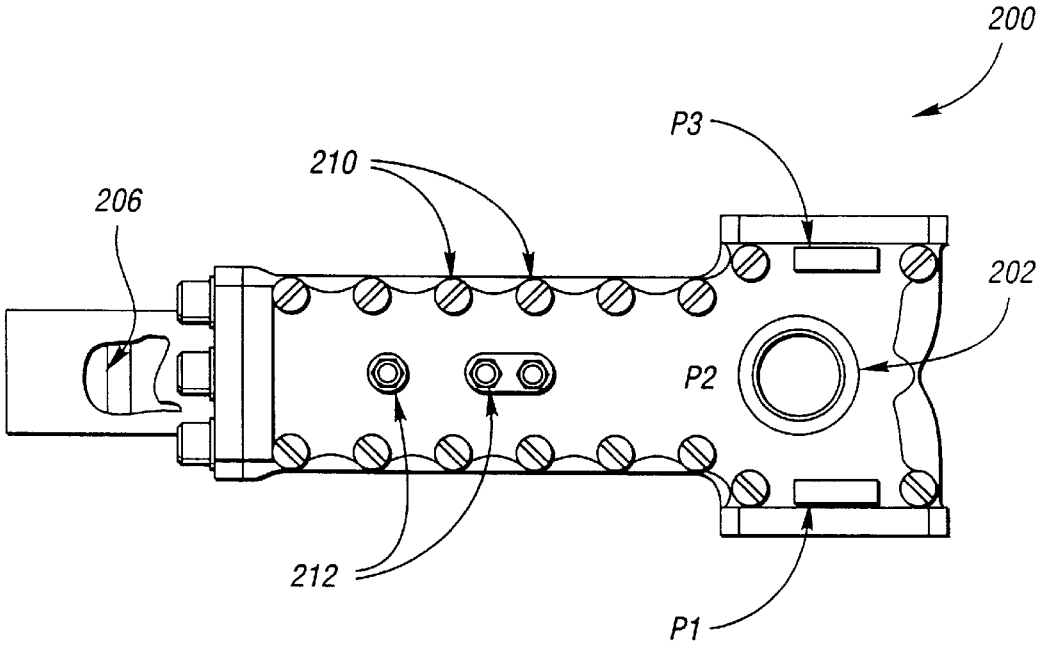
FIG. 6 is top view of the attenuator of FIG. 5.

FIGS. 5 and 6 illustrate a high power variable absorptive/reflective waveguide attenuator 200 in accordance with another embodiment of the present invention specifically implementing the attenuator arrangement of FIG. 1. More specifically, attenuator 200 is formed from a fixed junction circulator 202 connected to one end of a waveguide section 204, and a load 206 connected to the other end of waveguide section 204. Waveguide section 204 is formed from two half shell sections 207 and 208 fastened together with screws 210. Load 206 can be configured using any high power termination geometry known to one of ordinary skill in the art, and is preferably mounted to a heat sink such as a radiator or a shelf. A set of tuning elements 212 extend within the waveguide cavity to vary the amount of attenuation as further described below. The tuning elements 212 are preferably formed from a set of screws accessible from an external surface of waveguide 204 and passing through a threaded bore in one of the half shell sections of waveguide section 204.

The protrusion of tuning screws 212 into waveguide section 204 causes the waveguide to operate as a de-tuned filter allowing a portion of the microwave energy to pass and propagate into load 206 for dissipation in the form of heat. The remaining portion of microwave energy is reflected back to the P2 of circulator 202 for subsequent transfer/routing to the output port P3 without any significant decrease in magnitude.

Thus, the energy available at port P3 equals the incident energy at port P1 minus the energy dissipated in load 206, with negligible insertion loss in circulator 202. By varying the amount of protrusion of tuning screws 212 into the cavity of waveguide section 204, the amount of energy diverted to load 206 for dissipation can be varied, thereby allowing control of the amount of microwave energy available to output port P3.

Sensitivity of tuning elements 212 is dependent upon the size of their respective diameters or cross sections. Further, while waveguide attenuator 200 is particularly well suited for narrow-band applications, bandwidth can be enlarged by increasing the number of tuning elements 212.

Thus, the attenuators of the present invention advantageously overcome limitations of known attenuator designs. More specifically, because the heat-sink capabilities are not design limited, the attenuators of the present invention easily lends itself to high power applications. In addition, because the circulator provides good matching characteristics, the attenuator operates equally well in low power applications. Further, the amount of useable attenuation is not limited to industry standards of approximately 6 dB. Finally, the incorporation of a switchable circulator into a cascaded arrangement allows selective customizing of attenuation insitu simply by mapping which attenuators should be active to achieve the desired attenuation level.

While the best mode for carrying out the invention has been described in detail, those familiar with the art to which this invention relates will recognize various alternative designs and embodiments for practicing the invention as defmed by the following claims.

What is claimed is:

1. A variable attenuator comprising:

a circulator having an input port for receiving a signal, an intermediate port, an output port for outputting an attenuated signal, and means for routing of signals received at said input port to said intermediate port, and signals received at said intermediate port to said output port;

a section of transmission line comprising a waveguide having a first end coupled to the intermediate port and a second end coupled to a terminating load, said transmission line transmitting signals routed to said intermediate port toward the second end of the transmission; and at least one variable tuning element coupled to said transmission line, said tuning element comprising a tuning element variably extendable within said waveguide for reflecting a predetermined amount of signal passing through the transmission line back toward the first end, wherein the reflected portion of the received signal is routed by the circulator to said output port, and the remaining portion of the received signal is absorbed by the terminating load.

2. The attenuator of claim 1 wherein said at least one tuning element comprises a plurality of screws accessible from an external surface of said waveguide to allow adjustment of the portion protruding into said waveguide.

3. The attenuator of claim 1 wherein said terminating load is arranged to absorb the non-reflected portion of the received signal by dissipating the signal as heat.

4. The attenuator of claim 1 wherein said circulator comprises a latching circulator arranged to have signals received at said input port selectively routed directly to said output port or said intermediate port.

5. A cascaded attenator arrangement comprising at least a first and second attenuator, each attenuator being of the type recited in claim 4, the second attenuator having an input port connected to the output port of the first attenuator, wherein the level of the second attenuator can be selectively controlled by switching the latching of each circulator to customize the overall amount of attenuation.

6. A method for attenuating signals in a communication system comprising:

passing received signals to a circulator for routing of the received signals into a transmission line comprising a waveguide;

reflecting a predetermined portion of the received signals within the transmission line back to the circulator for routing to an output port by selectively adjusting the protrusion of at least one adjustable turning element into the waveguide; and absorbing the non-reflected portion of the received signal in a terminating load.

7. A method for attenuating signals in a communication system comprising the step of cascade connecting a plurality of attenuators together in series, each attenuator formed according to the method recited in claim 6, each attenuator having a latching type circulator, said method further comprising selectively switching the latching state of each circulator to change the overall amount of attenuation provided by the cascade connected attenuators.

8. The method of claim 6 wherein absorbing the non-reflected portion of the received signal comprises dissipating the signal as heat.

9. A variable and switchable attenuator comprising;

a latching circulator having an input port for receiving a signal, an intermediate port, an output port for outputting an attenuated signal, and a switching means for selectively routing signals received at said input port to either said intermediate port or said output port, and routing signals received at said intermediate port to said output port;

a section of transmission line comprising a waveguide intermediate port and a second end coupled to a terminating load, said transmission line transmitting signals routed to said intermediate port toward the second end of the transmission line; and at least one variable tuning element coupled to said transmission line, said tuning element comprising a tuning element variably extendable within said waveguide for reflecting a predetermined amount signal passing through the waveguide back toward the first end wherein the reflected portion of the received signal is routed by the latching circulator to said output port, and the remaining portion of the received signal is absorbed by the terminating load.

10. The attenuator of claim 9 wherein said switching means comprises means for reversing a magnetic field within said circulator.

* * * * *